US009217621B2

(12) United States Patent
He et al.

(10) Patent No.: US 9,217,621 B2
(45) Date of Patent: Dec. 22, 2015

(54) TURNING HOLDER

(75) Inventors: Yinquan He, Guangdong (CN); Panfeng Li, Guangdong (CN); Dayun Lin, Guangdong (CN)

(73) Assignee: Zhuhai Chunqiu Optical Instruments Co., LTD., Guangdong (CN)

( * ) Notice: Subject to any disclaimer, the term of this patent is extended or adjusted under 35 U.S.C. 154(b) by 393 days.

(21) Appl. No.: 13/819,712

(22) PCT Filed: Dec. 20, 2010

(86) PCT No.: PCT/CN2010/002095

§ 371 (c)(1),
(2), (4) Date: Mar. 21, 2013

(87) PCT Pub. No.: WO2012/027873

PCT Pub. Date: Mar. 8, 2012

(65) Prior Publication Data

US 2013/0180155 A1 Jul. 18, 2013

(30) Foreign Application Priority Data

Aug. 31, 2010 (CN) ..... 2010 1 0269700

(51) Int. Cl.
*A47B 96/00* (2006.01)
*F41G 1/387* (2006.01)
*F41G 11/00* (2006.01)

(52) U.S. Cl.
CPC ..... *F41G 1/387* (2013.01); *F41G 11/003* (2013.01)

(58) Field of Classification Search
CPC combination set(s) only.
See application file for complete search history.

(56) References Cited

U.S. PATENT DOCUMENTS

| | | | | | |
|---|---|---|---|---|---|
| 2,644,237 | A | * | 7/1953 | Pachmayr | 42/128 |
| 3,226,868 | A | * | 1/1966 | Mahoney | 42/128 |
| 3,750,318 | A | * | 8/1973 | Burris | 42/127 |
| 4,566,819 | A | * | 1/1986 | Johnston | 403/385 |
| 4,894,941 | A | * | 1/1990 | Karow, Jr. | 42/146 |
| 5,086,566 | A | * | 2/1992 | Klumpp | 42/126 |
| 5,425,191 | A | * | 6/1995 | Taylor et al. | 42/124 |
| 5,653,481 | A | * | 8/1997 | Alderman | 285/363 |
| 5,680,725 | A | * | 10/1997 | Bell | 42/127 |
| 5,787,630 | A | * | 8/1998 | Martel | 42/125 |

(Continued)

FOREIGN PATENT DOCUMENTS

| | | | |
|---|---|---|---|
| CN | 1052732 | A | 7/1991 |
| CN | 201780051 | U | 3/2011 |
| EP | 1847795 | A2 | 10/2007 |

*Primary Examiner* — Monica Millner
(74) *Attorney, Agent, or Firm* — Loginov & Associates, PLLC; William A. Loginov

(57) ABSTRACT

A turning holder enabling an easy operation and a convenient use without the need for repeated mounting and dismounting is provided. The turning holder comprises a base (11), a holder body (12), and a rotary body. A base sleeve (110) is provided on the base (11). A holder sleeve (120) is provided on the holder body (12). The rotary body includes a shaft sleeve (5), a clamping sleeve for rotary shaft (8), a pressure ring (9) and a locking means. The clamping sleeve for rotary shaft (8) is sleeved outside at a groove around an end of the shaft sleeve (5). The holder sleeve (120) is sleeved on the shaft sleeve (5) in a staggered position relative to the clamping sleeve for rotary shaft (8). The base sleeve (110) is sleeved around the clamping sleeve for rotary shaft (8) and fixedly connected therewith. The pressure ring (9) is sleeved around an end of the shaft sleeve (5) and presses the clamping sleeve for rotary shaft (8) from outside. The present invention can be widely used in the fields of firearms, bows and crossbows.

5 Claims, 3 Drawing Sheets

(56) References Cited

U.S. PATENT DOCUMENTS

| | | | | |
|---|---|---|---|---|
| 5,816,683 | A * | 10/1998 | Christiansen | 362/110 |
| 6,438,888 | B1 * | 8/2002 | Lin et al. | 42/114 |
| 6,629,381 | B1 * | 10/2003 | Keng | 42/124 |
| D492,977 | S * | 7/2004 | Squillante et al. | D22/109 |
| 7,272,904 | B2 * | 9/2007 | Larue | 42/127 |
| 7,367,152 | B2 * | 5/2008 | Samson | 42/128 |
| 7,562,484 | B2 * | 7/2009 | Kim | 42/114 |
| 7,694,450 | B2 * | 4/2010 | Keng | 42/124 |
| 7,908,782 | B1 * | 3/2011 | LaRue | 42/128 |
| 8,171,666 | B2 * | 5/2012 | Karagias | 42/124 |
| 8,327,574 | B2 * | 12/2012 | Sandler et al. | 42/126 |
| 2003/0230022 | A1 * | 12/2003 | Battaglia | 42/111 |
| 2004/0216352 | A1 * | 11/2004 | Wooten et al. | 42/127 |
| 2004/0244263 | A1 * | 12/2004 | Pettersson et al. | 42/128 |
| 2005/0241212 | A1 * | 11/2005 | Swan | 42/127 |
| 2007/0033852 | A1 * | 2/2007 | Adams | 42/124 |
| 2008/0034638 | A1 * | 2/2008 | Spuhr | 42/127 |
| 2008/0120891 | A1 * | 5/2008 | Wei | 42/90 |
| 2008/0148619 | A1 * | 6/2008 | Rogers et al. | 42/90 |
| 2008/0209789 | A1 | 9/2008 | Oz | |
| 2010/0269681 | A1 * | 10/2010 | Shipman et al. | 89/42.01 |

* cited by examiner

TURNING HOLDER

FIELD OF THE INVENTION

The present invention relates to a turning holder.

BACKGROUND OF THE INVENTION

At present, aimer has been widely used in the fields of firearms, bows and crossbows. Some auxiliary tools mounted on the firearm by holder are often required to be loaded when using the aimer. For example, in use of a red dot sight, a zoom lens is needed to amplify a target for a long distance and has to be dismounted for a short distance, thus the holder has to be mounted and demounted repeatedly. Besides, the operation is troublesome and inconvenient, thereby causing big inconvenience to the users.

SUMMARY

The technical problems to be solved by the present invention is to overcome the disadvantages of the prior art and provide a turning holder which is easy to operate and convenient to use without the need for repeated mounting and demounting.

The technical scheme adopted by the present invention is: the present invention comprises a base, a holder body and a rotary body, wherein a base sleeve is provided on the base, a holder sleeve is provided on the holder body, both the base sleeve and the holder sleeve are sleeved on the rotary body and are fixedly connected with the rotary body, and the holder body can rotate relative to the base by means of the rotary body.

The rotary body comprises a shaft sleeve, a clamping sleeve for rotary shaft, a pressure ring and a locking means, wherein the clamping sleeve for rotary shaft is sleeved outside around a groove at one end of the shaft sleeve, the holder sleeve is sleeved on the shaft sleeve in a staggered position relative to the clamping sleeve for rotary shaft, the base sleeve is sleeved on and fixedly connected with the clamping sleeve for rotary shaft, and the pressure ring is sleeved on the end part of the shaft sleeve and presses the clamping sleeve for rotary shaft from outside.

The locking means comprises a rotary shaft cover, a rotary shaft, a pressure spring, a turning cap, and steel ball(s), wherein the rotary shaft cover is positioned at one end of the shaft sleeve and is fitted with the shaft sleeve, a hole which is used for the rotary shaft cover to penetrate through is formed on the rotary shaft cover, the pressure spring is arranged on the rotary shaft with one end pressing on the rotary shaft cover and the other end pressing on the rotary shaft, the turning cap is positioned at the other end of the shaft sleeve and is connected with the rotary shaft, the clamping sleeve for rotary shaft is provided with at least one limiting hole, a through hole is formed on the shaft sleeve below the limiting hole, and the steel ball(s) are restricted in the limiting hole and the through hole by the conical surface of the rotary shaft.

The base comprises a locking nut, a pressure block, a pull rod and abase body, wherein the base sleeve is provided on the base body, the pull rod penetrates through the base body and the pressure block respectively and then is in thread fit with the locking nut, and the lower part of a combination of the pressure block and the base body forms a shrinking mouth fitting with a guide rail of the firearm.

An elastic gasket and a flat steel gasket are arranged between the locking nut and the pressure block.

The holder body comprises a holder cover and a holder base fixedly connected with the holder cover, wherein the holder sleeve is provided on the holder base.

The advantageous effects of the present invention are: the present invention comprises a base, a holder body and a rotary body, a base sleeve is provided on the base, a holder sleeve is provided on the holder body, both the base sleeve and the holder sleeve are sleeved on the rotary body and are fixedly connected with the rotary body, and the holder base can rotate relative to the base by means of the rotary body; and such a structure allows users to turn the holder body flexibly according to their needs and ensures that the auxiliary tool mounted on the holder body can conveniently aim at the aimer and move away, so that the present invention is easy to operate and convenient to use without having to be mounted and demounted repeatedly.

As the rotary body comprises a shaft sleeve, a clamping sleeve for rotary shaft, a pressure ring and a locking means, the clamping sleeve for rotary shaft is sleeved outside at a groove around one end of the shaft sleeve, the holder sleeve is sleeved on the shaft sleeve in a staggered position relative to the clamping sleeve for rotary shaft, the base sleeve is sleeved on and fixedly connected with the clamping sleeve for rotary shaft, the pressure ring is sleeved on the end part of the shaft sleeve and presses the clamping sleeve for rotary shaft from outside, the locking means comprises a rotary shaft cover, a rotary shaft, a pressure spring, a turning cap, and steel ball(s), the rotary shaft cover is positioned at one end of the shaft sleeve and is fitted with the shaft sleeve, a hole which is used for the rotary shaft cover to penetrate through is formed on the rotary shaft cover, the pressure spring is arranged on the rotary shaft with one end pressing on the rotary shaft cover and the other end pressing on the rotary shaft, the turning cap is positioned at the other end of the shaft sleeve and is connected with the rotary shaft, the clamping sleeve for rotary shaft is provided with at least one limiting hole, a through hole is formed on the shaft sleeve below the limiting hole, the steel ball(s) are restricted in the limiting hole and the through hole by the conical surface of the rotary shaft, and repeated locking and unlocking can be realized by the steel ball(s); and with such a design, the structure is more compact, and the using effect is even better, so that the present invention is compact in structure and good in using effect.

DETAILED DESCRIPTION OF THE EMBODIMENTS

Figure 1:
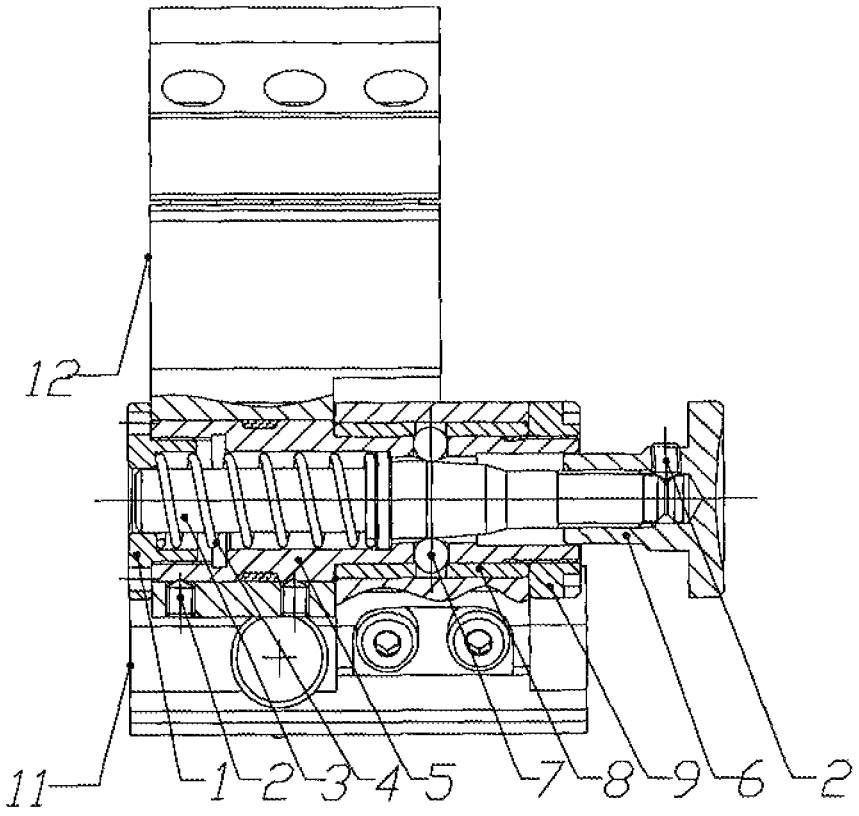
FIG. 1 is a cross-sectional view of the present invention.
Figure 2:
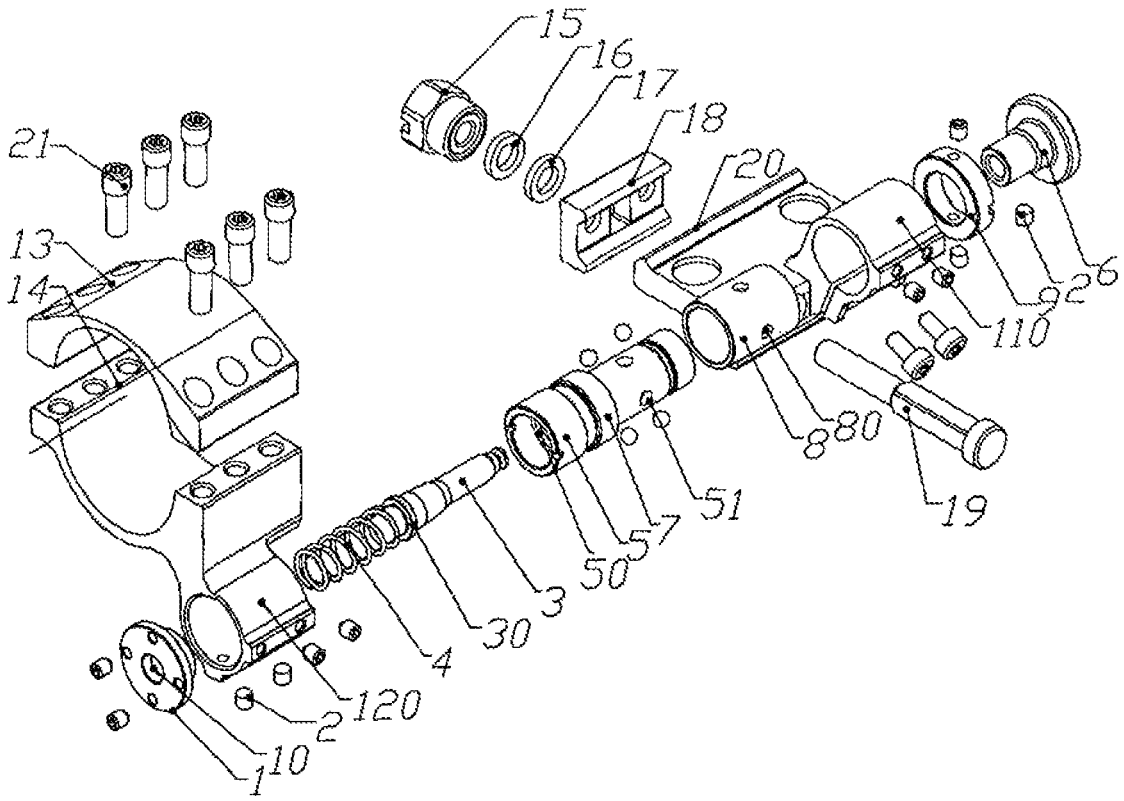
FIG. 2 is a left view of the present invention.
Figure 3:
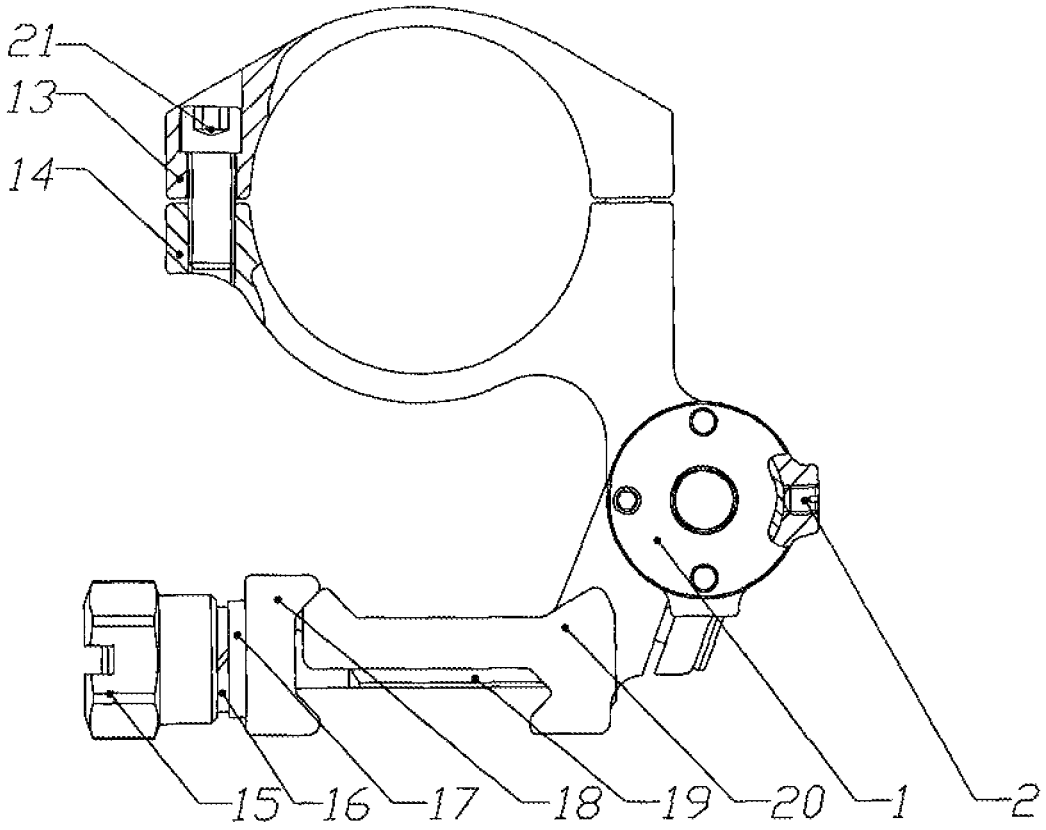
FIG. 3 is a schematic view of an explosive structure of the present invention.

As shown in FIGS. 1, 2 and 3, the present invention comprises abase (11), a holder base (12) and a rotary body, wherein a base sleeve (110) is provided on the base, a holder sleeve (120) is provided on the holder body (12), and both the base sleeve (110) and the holder sleeve (120) are sleeved on the rotary body and are fixedly connected with the rotary body. The rotary body comprises a rotary shaft cover (1), a rotary shaft (3), a pressure spring (4), a shaft sleeve (5), a turning cap (6), steel ball(s) (7), a clamping sleeve for rotary shaft (8) and a pressure ring (9). The rotary shaft (3) is located in the cavity of the shaft sleeve (5), the rotary shaft cover (1) is positioned at one end of the shaft sleeve (5) and is fitted with the shaft sleeve (5), the rotary shaft cover (1) is fixed on the shaft sleeve (5) by a fixing screw (2), the pressure spring (4) is arranged on the rotary shaft (3) with one end pressing on the rotary shaft cover (1) and the other end pressing on a limiting ring (30) on the rotary shaft (3), and the limiting ring (30) is clamped at a step (50) inside the cavity of the shaft sleeve (5). A hole (10) which is used for the rotary shaft (3) to penetrate through is provided on the rotary shaft cover (1), and the clamping sleeve for rotary shaft (8) is sleeved outside at a groove around one end of the shaft sleeve (5). The holder sleeve (120) is sleeved on the shaft sleeve (5) in a staggered position relative to the clamping sleeve for rotary shaft (8). The base sleeve (110) is sleeved on and fixedly connected with the clamping sleeve for rotary shaft (8). The pressure ring (9) is sleeved on the end portion of the shaft sleeve (5) and presses the clamping sleeve for rotary shaft (8) from outside, the pressure ring (9) is fastened on the shaft sleeve (5) by the fixing screw (2). The turning cap (6) is located at the other end of the shaft sleeve (5) and is connected with the rotary shaft (3). Four limiting recesses (80) arranged at 90 degrees to each other are formed on the annular surface of the clamping sleeve for rotary shaft (8), and through hole(s) (51) are formed on the shaft sleeve (5) below the limiting recesses (80) in a corresponding way. The steel ball(s) (7) are located in the through hole (51) and the limiting recesses (80), the limiting recesses (80) are slightly smaller than the diameters of the steel ball(s) (7), and the rotary shaft (3) which is in a conic shape is located below the steel ball(s) (7). The base (11) comprises a locking nut (15), a pressure block (18), a pull rod (19) and a base body (20), wherein the base sleeve (110) is provided on the base body (20), the pull rod (19) penetrates through the base body (20) and the pressure block (18) respectively and then is in thread fit with the locking nut (15), the lower part of a combination of the pressure block (18) and the base body (20) forms a shrinking mouth fitting with a guide rail of the firearm, and an elastic gasket (16) and a flat steel gasket (17) are arranged between the locking nut (15) and the pressure block (18). The holder body (12) comprises a holder cover (13) and a holder base (14) which are fixedly connected by a screw (21), and the holder sleeve 120 is provided on the holder base (14) and is fixedly connected with the shaft sleeve (5) by the fixing screw (2).

Detailed description of the invention: in an example of using the zoom lens, the base (11) is fixed on the guide rail of the firearm, the zoom lens is mounted on the holder body (12), and the turning cap (6) is pressed down to force the rotary shaft (3) to penetrate backwards through the hole (10). At this time, the steel ball (s) (7) lose the supporting force form the conical surface of the rotary shaft (3), the shaft sleeve (5) rotates relative to the clamping sleeve for rotary shaft (8), the steel ball(s) (7) move out of the limiting recesses (80), the locking effect is lost, the zoom lens on the holder body (12) is aimed at the sight vane and plays a role of amplifying, after this, the turning cap (6) is released, the rotary shaft (3) returns to its original position under the effect of a cylindrical pressure spring (4), the steel ball(s) (7) are forced back into the limiting recesses (80) again by the conical surface of the rotary shaft (3), and the steel ball(s) (7) will lock the clamping sleeve for rotary shaft (8) and the shaft sleeve (5) again.

The present invention can be widely applied to the field of the firearm and bow and crossbow.

What is claimed is:

1. A turning holder, comprising a base and a holder body, wherein said turning holder further comprises a rotary body, wherein a base sleeve is provided on said base, a holder sleeve is provided on said holder body, both said base sleeve and said holder sleeve are sleeved on said rotary body and are fixedly connected with said rotary body, and said holder body can rotate relative to said base by means of said rotary body, wherein said rotary body comprises a rotary shaft, a shaft sleeve, a clamping sleeve for the rotary shaft, a pressure ring and a locking means, wherein said clamping sleeve for the rotary shaft is sleeved outside at a groove around one end of said shaft sleeve, said holder sleeve is sleeved on said shaft sleeve in a staggered position relative to said clamping sleeve for the rotary shaft, said base sleeve is sleeved on and fixedly connected with said clamping sleeve for the rotary shaft, and said pressure ring is sleeved on the end part of said shaft sleeve and presses said clamping sleeve for the rotary shaft from outside.

2. The turning holder according to claim 1, wherein said locking means comprises a rotary shaft cover, a rotary shaft, a pressure spring, a turning cap and steel ball(s), wherein one end of said rotary shaft cover is fitted with said shaft sleeve, a hole which is used for said rotary shaft to penetrate through is formed on said rotary shaft cover, said pressure spring is arranged on said rotary shaft with one end pressing on said rotary shaft cover and the other end pressing on said rotary shaft, said turning cap is located at the other end of said shaft sleeve and is connected with said rotary shaft, at least one limiting hole is formed on said clamping sleeve for rotary shaft, at least one through hole is formed on said shaft sleeve below said limiting hole, and said steel ball(s) are restricted in said limiting hole and said through hole.

3. The turning holder according to claim 1, wherein said base comprises a locking nut, a pressure block, a pull rod and a base body, wherein said base sleeve is provided on said base body, said pull rod penetrates through said base body and said pressure block respectively and then is in thread fit with said locking nut, and a shrinking mouth fitting with the guide rail of the firearm is formed at the lower part of a combination of said pressure block and said base body.

4. The turning holder according to claim 3, wherein an elastic gasket and a flat steel gasket are arranged between said locking nut and said pressure block.

5. The turning holder according to claim 1, wherein said holder body comprises a holder cover and a holder base connected fixedly with said holder cover, wherein said holder sleeve is provided on said holder base.

* * * * *